US010252144B2

(12) United States Patent
Contant et al.

(10) Patent No.: US 10,252,144 B2
(45) Date of Patent: Apr. 9, 2019

(54) GLOVE FOR A HOCKEY OR LACROSSE PLAYER

(71) Applicant: BAUER HOCKEY CORP., St-Jerome (CA)

(72) Inventors: Mathieu Contant, Verdun (CA); Marco Beauregard, Morin Heights (CA); Alexandre Leblanc, Montreal (CA)

(73) Assignee: BAUER HOCKEY, LLC, Exeter, NH (US)

( * ) Notice: Subject to any disclaimer, the term of this patent is extended or adjusted under 35 U.S.C. 154(b) by 290 days.

(21) Appl. No.: 13/968,839

(22) Filed: Aug. 16, 2013

(65) Prior Publication Data

US 2015/0047088 A1 Feb. 19, 2015

(51) Int. Cl.

| | |
|---|---|
| ***A63B 71/14*** | (2006.01) |
| *A63B 102/24* | (2015.01) |
| *A63B 102/14* | (2015.01) |

(52) U.S. Cl.

CPC ..... *A63B 71/143* (2013.01); *A63B 2102/14* (2015.10); *A63B 2102/24* (2015.10)

(58) Field of Classification Search

CPC ..... A63B 2102/24; A63B 71/143

See application file for complete search history.

(56) References Cited

U.S. PATENT DOCUMENTS

| | | | | |
|---|---|---|---|---|
| 1,841,193 | A * | 1/1932 | Lidston | A63B 71/143 2/16 |
| 3,626,515 | A | 12/1971 | Murray | |
| 4,815,147 | A * | 3/1989 | Gazzano | A63B 71/143 2/161.1 |
| 4,930,162 | A * | 6/1990 | Cote | A63B 71/143 2/16 |
| 5,168,576 | A * | 12/1992 | Krent | A41D 13/0156 2/16 |
| 5,237,703 | A | 8/1993 | Brine et al. | |
| 5,329,639 | A * | 7/1994 | Aoki | A63B 71/143 2/16 |
| 5,488,739 | A * | 2/1996 | Cardinal | A63B 71/143 2/16 |
| 5,511,243 | A * | 4/1996 | Hall | A63B 71/143 2/16 |
| 5,787,506 | A * | 8/1998 | Wilder | A63B 71/143 2/159 |
| 5,946,720 | A * | 9/1999 | Sauriol | A63B 71/143 2/16 |

(Continued)

*Primary Examiner* — Richale Quinn
*Assistant Examiner* — Anne Kozak

(57) ABSTRACT

A hockey or lacrosse glove comprising a cuff and a hand receiving portion having a palm sheet, a dorsal sheet extending longitudinally from a proximal end located adjacent the distal end of the cuff to a distal end that is, in use, located generally above the proximal articulation of each finger, and four finger gussets, each finger gusset having a distal end for covering the distal end of the finger. The glove also has at least one protector extending to an end located generally above the distal end of the finger gusset and comprising a single pocket and a padding element contained in the single pocket, the padding element defining at least one flexion zone such that, in use, flexing of the player's hand or finger imparts movement of the padding element.

37 Claims, 19 Drawing Sheets

(56) References Cited

U.S. PATENT DOCUMENTS 5,983,396 A * 11/1999 Morrow ..... A63B 71/143 2/16
6,122,769 A * 9/2000 Wilder ..... A63B 71/143 2/159
6,233,744 B1 * 5/2001 McDuff ..... A63B 71/143 2/16
6,584,615 B1 7/2003 Wilder et al.
6,813,780 B2 11/2004 Morrow
6,959,453 B2 11/2005 Best
6,990,690 B2 1/2006 Gait
7,313,831 B2 1/2008 Wilder et al.
7,406,719 B2 * 8/2008 Aoki ..... A41D 19/01523 2/16
8,132,269 B1 3/2012 Ibon et al.
2003/0163862 A1 * 9/2003 Hoffman ..... A63B 71/143 2/161.1
2004/0111785 A1 * 6/2004 Sande ..... A63B 71/143 2/161.1
2004/0261155 A1 * 12/2004 Agathos ..... A63B 71/143 2/161.1
2005/0091721 A1 * 5/2005 Best ..... A63B 71/143 2/16
2005/0114984 A1 * 6/2005 Morrow ..... A63B 71/143 2/161.1
2005/0251893 A1 * 11/2005 Hayden ..... A41D 19/01523 2/161.1
2006/0130210 A1 * 6/2006 Gait ..... A41D 19/01523 2/160
2007/0245451 A1 * 10/2007 Desjardins ..... A41D 19/01523 2/159
2008/0034469 A1 * 2/2008 Beland ..... A63B 71/143 2/161.1
2008/0034471 A1 * 2/2008 Beland ..... A63B 71/143 2/161.6
2008/0120753 A1 * 5/2008 Desjardins ..... A41D 13/088 2/16
2008/0244799 A1 * 10/2008 Winningham ... A41D 19/01523 2/16
2008/0313785 A1 * 12/2008 Rudd ..... A63B 71/143 2/16
2009/0019613 A1 * 1/2009 Carcaterra ..... A63B 71/143 2/16
2009/0044306 A1 * 2/2009 Lamson ..... A41D 19/01523 2/16
2009/0300821 A1 * 12/2009 Winningham ..... A63B 71/143 2/161.1
2011/0067165 A1 3/2011 Fream et al.
2011/0126342 A1 * 6/2011 Bautista ..... A63B 71/143 2/161.1
2012/0054937 A1 * 3/2012 Robaire ..... A63B 71/143 2/16
2012/0131714 A1 * 5/2012 Copeland ..... A63B 71/143 2/16
2012/0131716 A1 * 5/2012 Copeland ..... A63B 71/143 2/20
2012/0131725 A1 * 5/2012 Copeland ..... A63B 71/143 2/161.1
2012/0297514 A1 * 11/2012 Aoki ..... A63B 71/143 2/20
2013/0269076 A1 * 10/2013 Arnone ..... A41D 19/01523 2/20
2014/0026280 A1 * 1/2014 Clark ..... A41D 19/01523 2/16
2014/0026282 A1 * 1/2014 Rusakov ..... A63B 71/143 2/20
2014/0143924 A1 * 5/2014 Rusakov ..... A63B 71/143 2/16
2014/0143925 A1 * 5/2014 Chorne ..... A63B 71/143 2/20
2014/0143926 A1 * 5/2014 Brown ..... A63B 71/143 2/20
2014/0201880 A1 * 7/2014 Binge ..... A63B 71/141 2/20
2014/0331376 A1 * 11/2014 Chorne ..... A41D 13/082 2/16
2015/0047087 A1 * 2/2015 Contant ..... A63B 71/143 2/16
2015/0047088 A1 * 2/2015 Contant ..... A63B 71/143 2/16
2015/0106990 A1 * 4/2015 Gait ..... A63B 71/143 2/20
2015/0265904 A1 * 9/2015 Lemieux ..... A63B 71/143 2/161.1
2015/0305416 A1 * 10/2015 Chorne ..... A63B 71/143 2/16

* cited by examiner

GLOVE FOR A HOCKEY OR LACROSSE PLAYER

FIELD OF THE INVENTION

The present invention relates to a glove for a hockey or lacrosse player.

BACKGROUND OF THE INVENTION

Hockey and lacrosse players typically wear protective gloves during game play in order to prevent injuries to their hands. As such, much attention is given to the design and construction of the gloves in order to provide an appropriate level of protection and comfort.

In a traditional glove construction, the dorsal and finger portions comprise a plurality of distinct dorsal and finger protectors (padding elements enclosed in distinct separate pockets) for protecting the player's hand and fingers, these protectors being separated by a plurality of gaps, spaces, grooves, channels or flexion zones. The dorsal and finger portions often include distinct separate protectors of different shapes which are stitched beside one another to protect the entirety of the player's hand. Each of the padding elements is contained within a respective distinct separate pocket. The dorsal and finger protectors are thus slightly spaced apart in order to provide flexibility to the dorsal and finger portions of the glove. By virtue of the plurality of distinct dorsal and finger protectors and plurality of flexion zones, the traditional glove therefore permits a level of flexibility while also providing protection.

However, it is understood that providing a plurality of dorsal and finger protectors involves a plurality of components and manufacturing steps, because for each protector, a pocket enclosing a padding element must be stitched to the dorsal/finger sheet. As such, there is a need in the industry for a hockey or lacrosse glove which is less costly to manufacture while still providing a suitable level of protection and flexion to the player's hand and fingers. Thus, it is a feature to produce gloves that provide flexibility, comfort and protection and to produce gloves that reduce design and production costs, that are less complex in design, and that have fewer components and/or require less manufacturing steps.

SUMMARY OF THE INVENTION

In accordance with a broad aspect, the invention provides a glove for protecting a hand of a hockey or lacrosse player, the player's hand having a wrist, a palm, a dorsal side, four fingers and a thumb, each finger extending from a proximal articulation to a distal end, the hockey or lacrosse glove comprising a hand receiving portion and a cuff for at least partially covering the wrist, the cuff extending longitudinally from a proximal end to a distal end, the hand receiving portion comprising: a palm sheet for covering the palm of the player's hand; a dorsal sheet for covering the dorsal side of the player's hand, the dorsal sheet extending longitudinally from a proximal end located adjacent the distal end of the cuff to a distal end that is, in use, located generally above the proximal articulation of each finger; a thumb sheath for protecting the thumb of the player's hand; and four finger gussets for receiving the four fingers, each finger gusset having a distal end for covering the distal end of the finger; and at least one protector comprising (i) a single pocket mounted to one of the four finger gussets and extending longitudinally from a first end proximate the distal end of the dorsal sheet to a second end located generally above the distal end of the finger gusset and (ii) a padding element contained in the single pocket, the padding element defining at least one flexion zone such that, in use, flexing of the player's finger imparts movement of the padding element.

In accordance with another broad aspect, the invention provides a glove for protecting a hand of a hockey or lacrosse player, the player's hand having a wrist, a palm, a dorsal side, four fingers and a thumb, each finger extending from a proximal articulation to a distal end, the hockey or lacrosse glove comprising a hand receiving portion and a cuff for at least partially covering the wrist, the cuff extending longitudinally from a proximal end to a distal end, the hand receiving portion comprising: a palm sheet for covering the palm of the player's hand; a dorsal sheet for covering the dorsal side of the player's hand, the dorsal sheet extending longitudinally from a proximal end located adjacent the distal end of the cuff to a distal end that is, in use, located generally above the proximal articulation of each finger; a thumb sheath for protecting the thumb of the player's hand; four finger gussets for receiving the four fingers, each finger gusset having a distal end for covering the distal end of one of the four fingers; and at least one protector comprising (i) a single pocket mounted to the dorsal sheet and one of the four finger gussets and extending longitudinally from a first end located between the proximal and distal ends of the dorsal sheet to a second end located generally above the distal end of the finger gusset and (ii) a padding element contained in the single pocket, the padding element defining at least one flexion zone such that, in use, flexing of the player's hand or finger imparts movement of the padding element.

In accordance with a further broad aspect, the invention provides a glove for protecting a hand of a hockey or lacrosse player, the player's hand having a wrist, a palm, a dorsal side, four fingers and a thumb, each finger extending from a proximal articulation to a distal end, the hockey or lacrosse glove comprising a hand receiving portion and a cuff for at least partially covering the wrist, the cuff extending longitudinally from a proximal end to a distal end, the hand receiving portion comprising: a palm sheet for covering the palm of the player's hand; a dorsal sheet for covering the dorsal side of the player's hand, the dorsal sheet extending longitudinally from a proximal end located adjacent the distal end of the cuff to a distal end that is, in use, located generally above the proximal articulation of each finger; a thumb sheath for protecting the thumb of the player's hand; four finger gussets for receiving the four fingers, each finger gusset having a distal end for covering the distal end of one of the four fingers; and at least one protector comprising (i) a single pocket mounted to the dorsal sheet and one of the four finger gussets and extending longitudinally from a first end located adjacent the proximal end of the dorsal sheet to a second end located generally above the distal end of the finger gusset and (ii) a padding element contained in the single pocket, the padding element defining at least one flexion zone such that, in use, flexing of the player's hand or finger imparts movement of the padding element.

Other aspects and features of the present invention will become apparent to the persons skilled in the art upon review of the following description of embodiments of the invention in conjunction with the accompanying figures.

BRIEF DESCRIPTION OF THE DRAWINGS

A detailed description of the embodiments of the present invention is provided herein below, by way of example only, with reference to the accompanying drawings, in which.

Figure 1A:
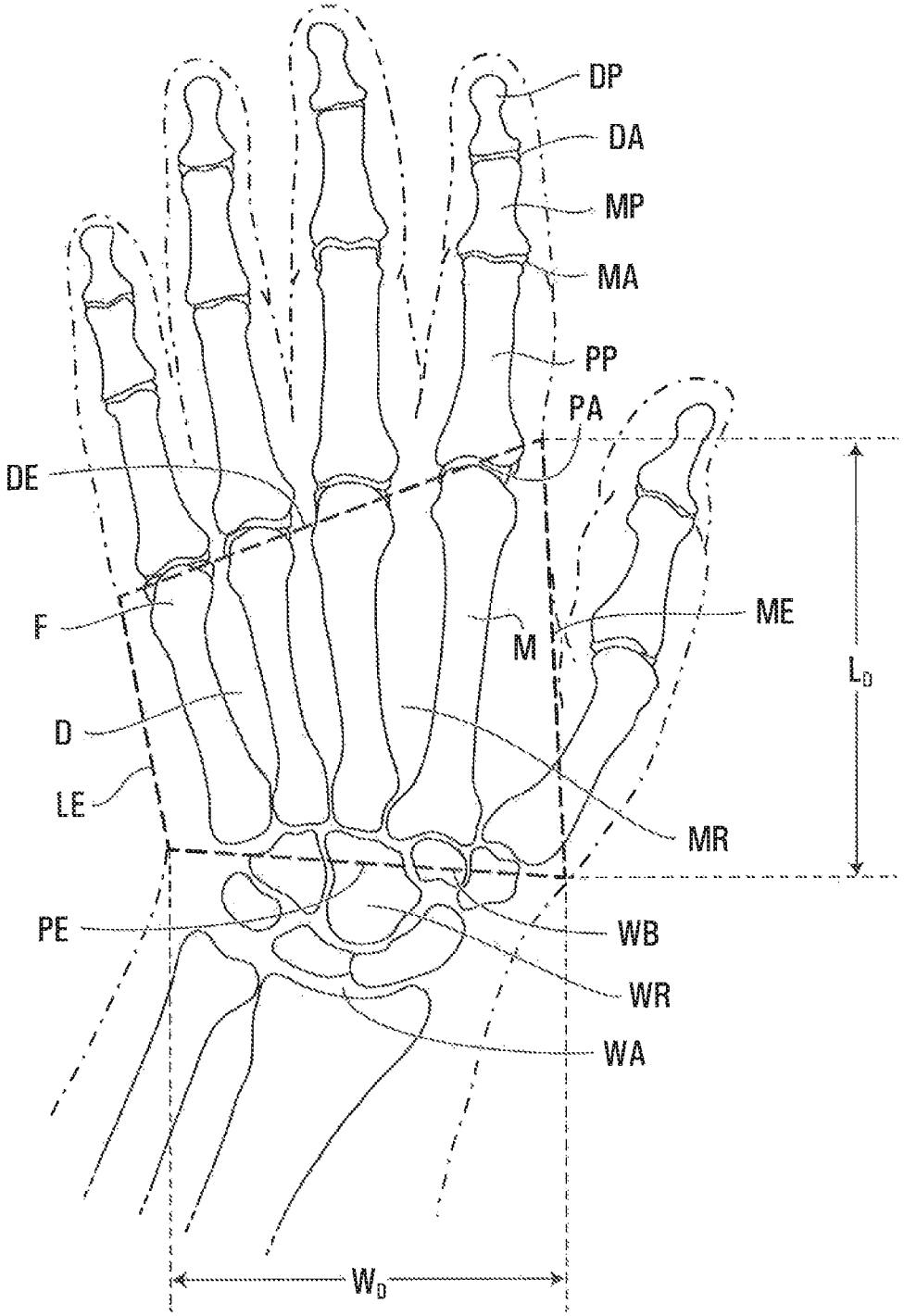
FIG. 1A is a top view of a human hand with the integument of the hand shown in broken lines and the bones shown in full lines.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 1B:
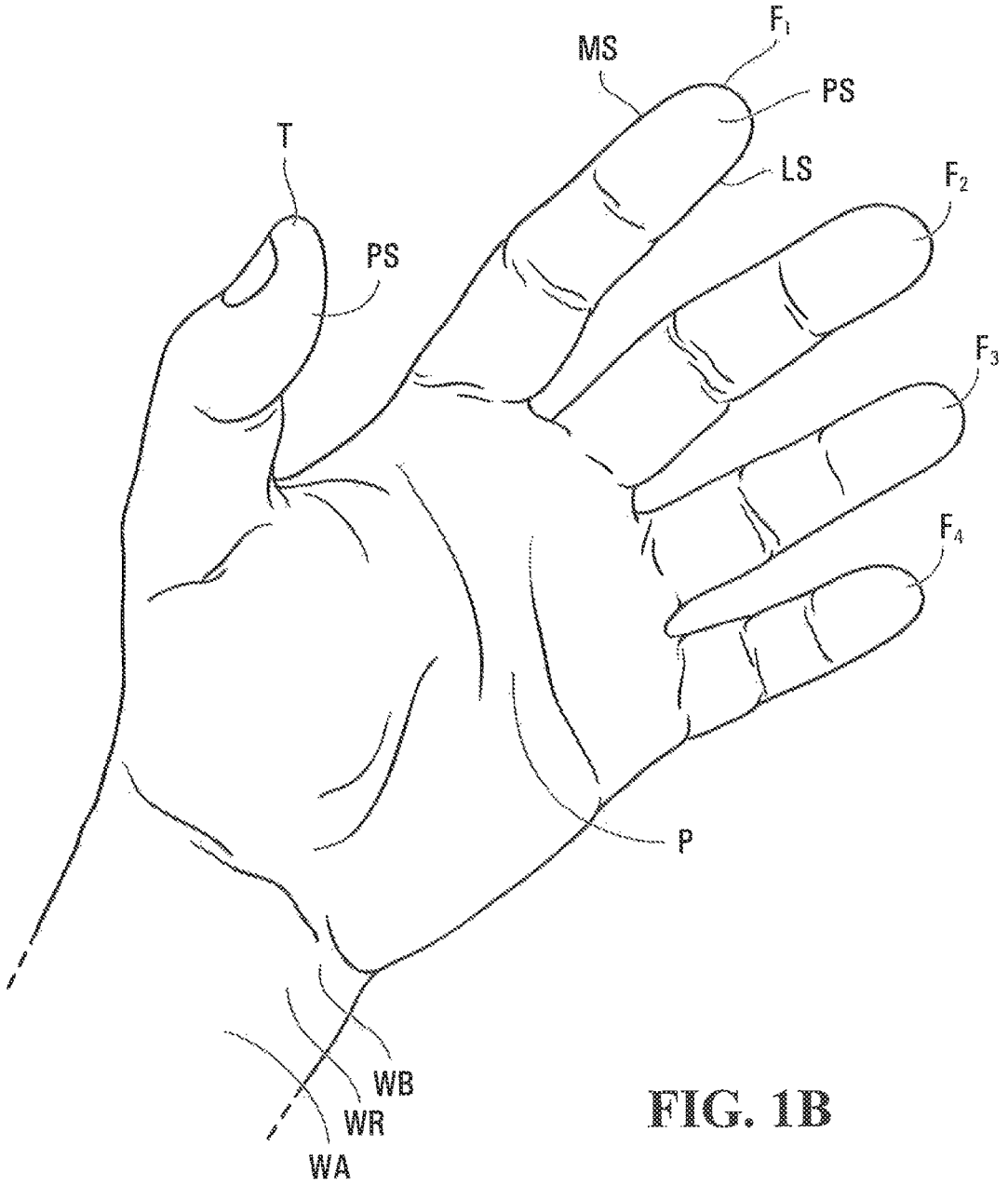
FIG. 1B is a bottom perspective view of a human hand.
Figure 1C:
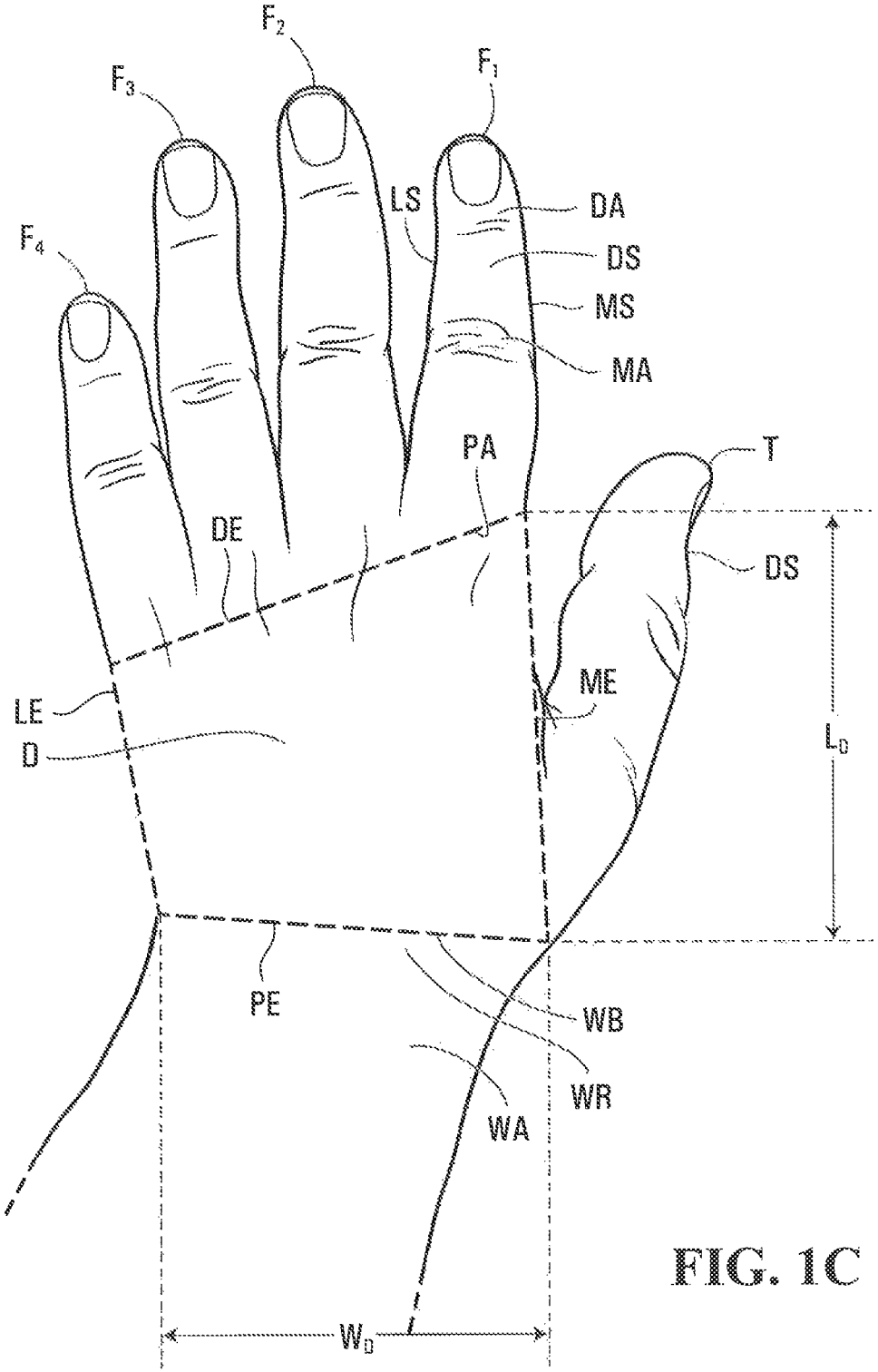
FIG. 1C is a top perspective view of the human hand of FIG. 1B.

As shown in FIGS. 1A, 1B and 1C, a human hand comprises a wrist WR, a palm P, a dorsal side D, four fingers (index finger $F_1$, middle finger $F_2$, ring finger $F_3$ and little finger $F_4$) and a thumb T. The wrist WR has a proximal edge WA and a distal edge WB.

Each finger has a palm surface PS, a dorsal surface DS, a lateral surface LS, a medial surface MS, a metacarpal M, a proximal articulation PA, a proximal phalanx PP, a middle articulation MA, a middle phalanx MP, a distal articulation DA and a distal phalanx DP.

The metacarpals M of the human hand define a metacarpal region MR having a medial edge ME, a lateral edge LE, a proximal edge PE and a distal edge DE. The thumb T also has a palm surface PS and a dorsal surface DS.

As best seen in FIGS. 1A and 1C, the dorsal side D of the hand may be generally seen as a trapezoid having a length $L_D$ from the distal edge WB of the wrist WR (or the proximal edge PE of the metacarpal region MR of the hand) to the proximal articulations PA of each finger (or the distal edge DE of the metacarpal region MR of the hand) and a width $W_D$ from the lateral edge of the dorsal side D (i.e. the lateral edge LE of the metacarpal region MR) to the medial edge of the dorsal side D (i.e. the medial edge ME of the metacarpal region MR) (see the trapezoid shown in broken lines).

Figure 2:
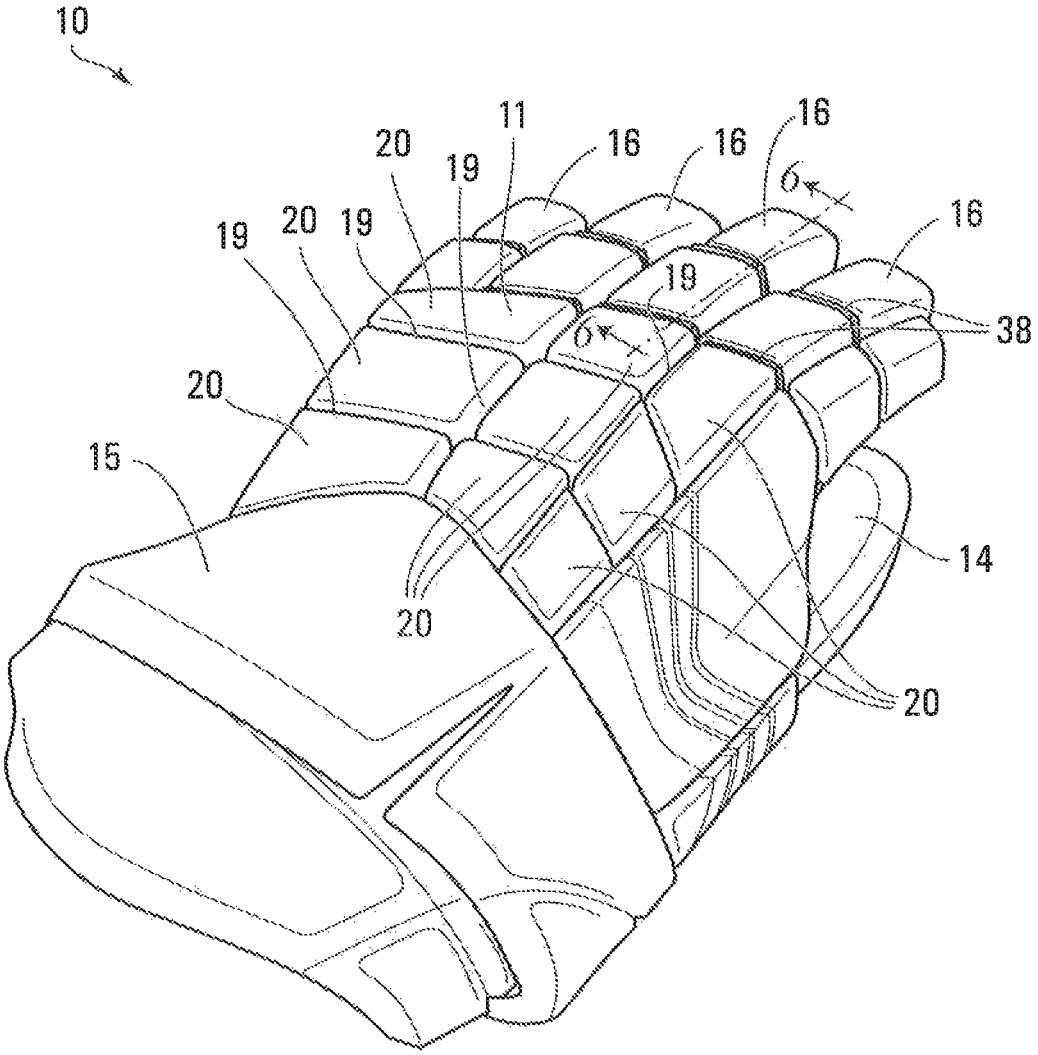
FIG. 2 (Prior Art)
FIG. 2 is a perspective view of a prior art hockey or lacrosse glove.
Figure 3:
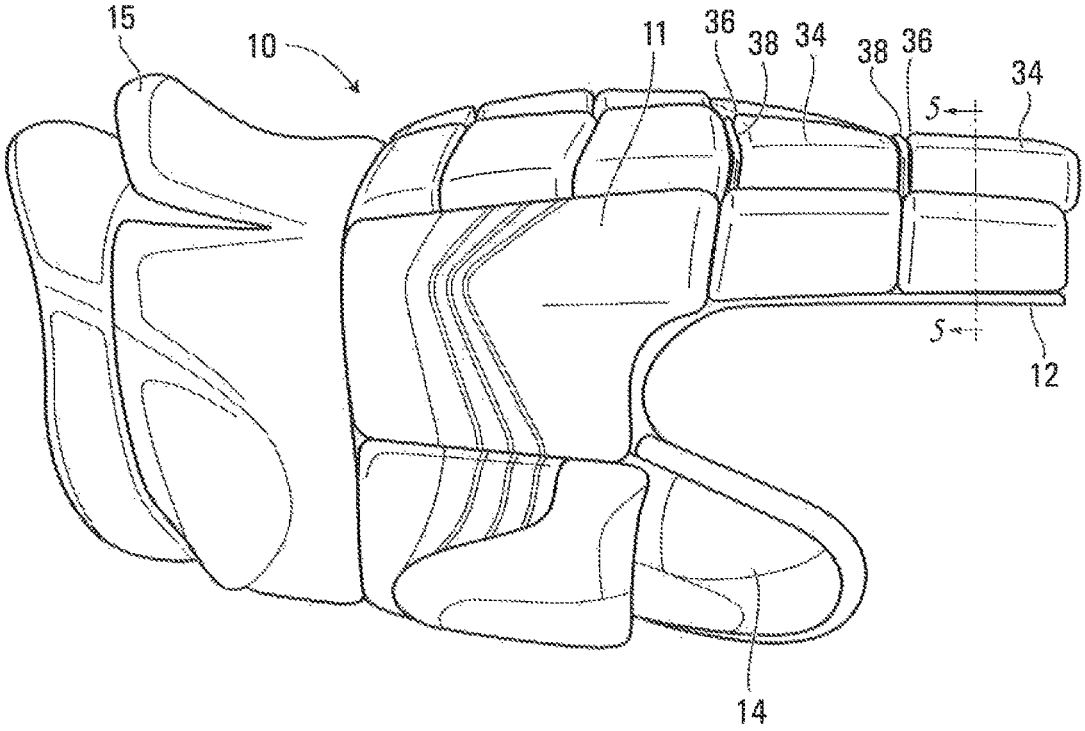
FIG. 3 (Prior Art)
FIG. 3 is a side view of the prior art hockey or lacrosse glove of FIG. 2.
Figure 4:
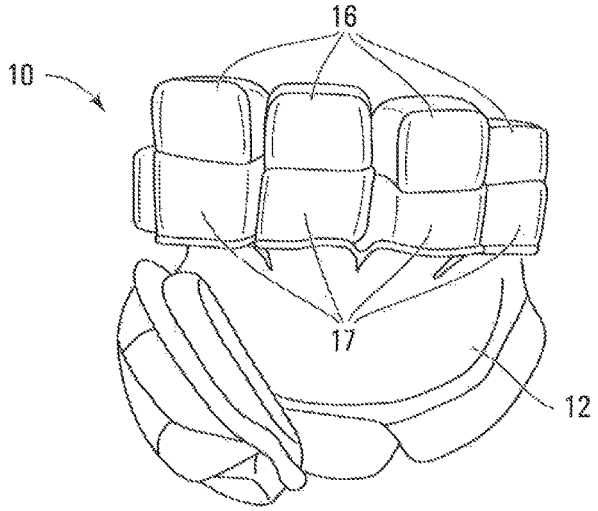
FIG. 4 (Prior Art)
FIG. 4 is a front view of the prior art hockey or lacrosse glove of FIG. 2.

FIGS. 2 to 4 illustrate a prior art hockey or lacrosse glove 10 for receiving the hand of a player. The glove 10 has a hand receiving portion 11 that comprises a lower sheet 12 for facing the palm of the hand and an upper sheet 13 for covering the dorsal side of the hand. Each of the lower and upper sheets 12, 13 may comprise palm and dorsal sheets connected to or integrated with respective palm and dorsal finger sheets. The glove 10 also comprises a thumb sheath 14 for covering the thumb and a cuff 15 for covering the player's wrist and lower forearm.

The hand receiving portion 11 also has finger sheaths 16 for protecting the player's fingers. Each finger sheath 16 includes a gusset 17 for receiving the finger and finger protectors 34 for protecting the finger.

Figure 5:
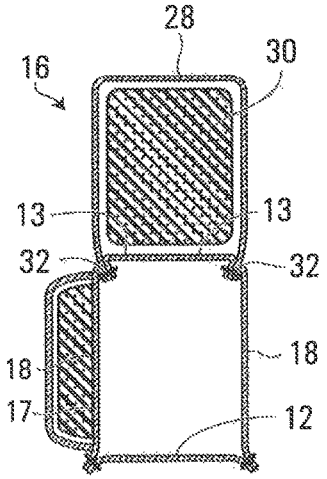
FIG. 5 (Prior Art)
FIG. 5 is an enlarged cross-sectional view taken along lines 5-5 of FIG. 3.
Figure 6:
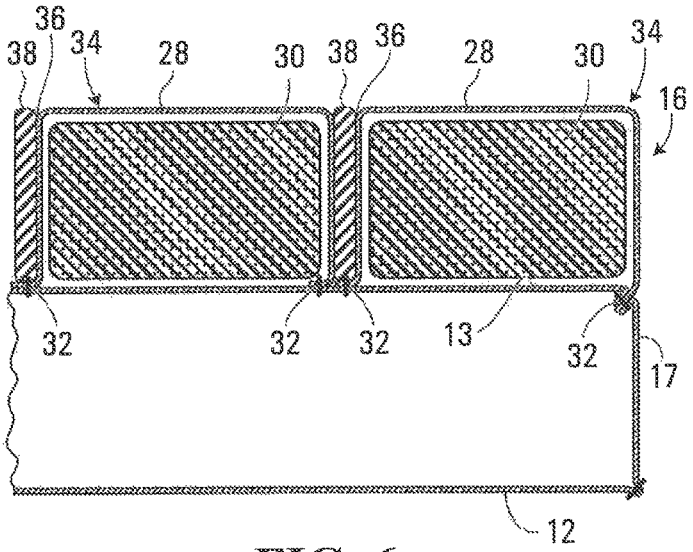
FIG. 6 (Prior Art)
FIG. 6 is an enlarged cross-sectional view taken along lines 6-6 of FIG. 2.

As best shown in FIGS. 5 and 6, the respective lower and upper sheets 12, 13 are connected to each other via a side finger web 18 to create the finger gussets 17. The finger gusset 17 is made of portions of the side finger web 18, a portion of the lower sheet 12 and a portion of the upper sheet 13.

Each of the finger sheaths 16 includes first and second pockets 28 with first and second padding elements 30 received in the respective pockets 28. The pockets 28 are formed by stitching a layer of material to the finger gusset 17 (see stitches 32). It is understood that the stitches 32 at least partially surround each pocket 28 for closing the pocket 28 and holding the pocket 28 and padding element 30 in place on the finger gusset 17. The pocket 28 is directly mounted on the finger gusset 17 and the upper layer of the finger gusset 17 serves as a base layer for the pocket 28. In other words, the pocket 28 and finger gusset 17 share a common layer, namely, the upper layer of the finger gusset 17.

The pockets 28 and padding elements 30 on each finger sheath 16 therefore define first and second distinct finger protectors 34 and the glove has gaps, spaces, grooves or channels 36, which act as flexion zones that allow flexion of the dorsal region of the finger sheath 16 when the player's finger flexes.

The prior art glove 10 further includes a plurality of dorsal protectors 20 which cooperatively cover the dorsal region of the glove and which generally overly the dorsal side of the player's hand. Each of the dorsal protectors 20 includes a pocket and a padding element. The pockets are formed by stitching a layer of material to the upper sheet 13. The upper sheet 13 therefore acts as a base layer on which pockets are attached. It is understood that stitches at least partially surround the padding elements to hold the pocket and padding element in place on the upper sheet 13.

In the prior art glove 10, the dorsal protectors 20 are spaced such as to provide a level of flexibility in both a longitudinal and a lateral direction of the glove 10. The dorsal protectors 20 are thus separated by gaps, spaces, grooves or channels 19 which act as flexion zones that allow flexion of the dorsal region of the glove 10 when the player's hand flexes. For example, as seen in FIG. 2, the dorsal region of the glove may have two longitudinal flexion zones 19 and two transversal flexion zones 19 for adding flexibility to the dorsal region and allowing some degree of flexion of the player's hand.

The prior art glove 10 may also include first and second spacers 38 positioned between the dorsal protectors 20 and first finger protector 34 and between first and second finger protectors 34 and occupying the flexion zones 36 for providing further protection to the player's finger articulations.

Hence, the prior art glove 10 has nine distinct dorsal protectors 20 separated by four gaps, spaces, grooves, channels or flexion zones 19 and two distinct finger protectors 34 with two flexion zones 36 for each finger sheath 16.

As it is well known in the art, the flexibility of the prior art gloves is largely dependent on the presence of these gaps, spaces, grooves, channels or flexion zones between the distinct dorsal and finger protectors and a prior art glove thus generally comprises at least three distinct dorsal protectors separated by two flexion zones and two distinct finger protectors with two flexion zones for each finger sheath.

Figure 7:
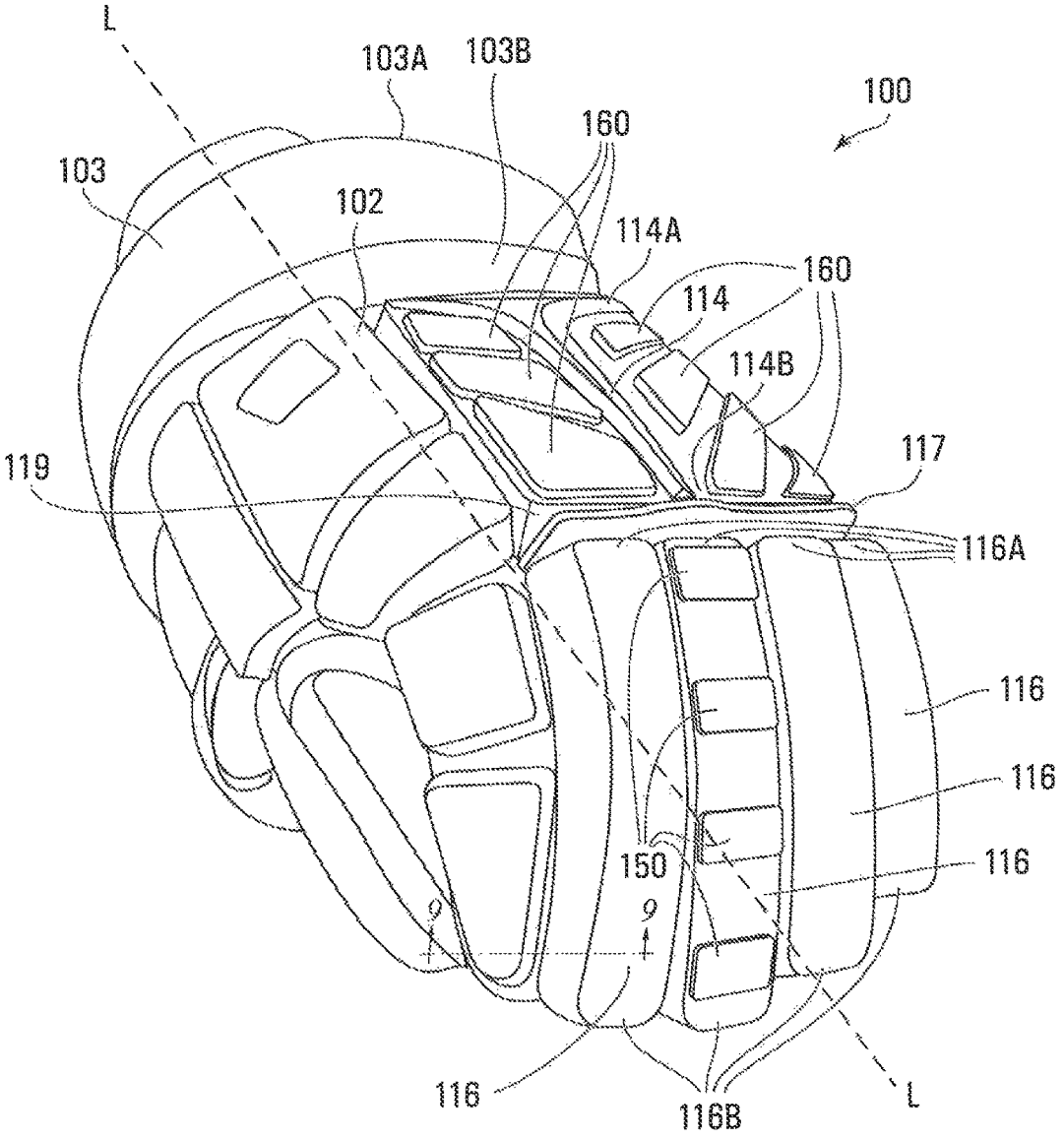
FIG. 7 is a perspective view of a hockey or lacrosse glove constructed in accordance with a first embodiment of the invention.
Figure 8:
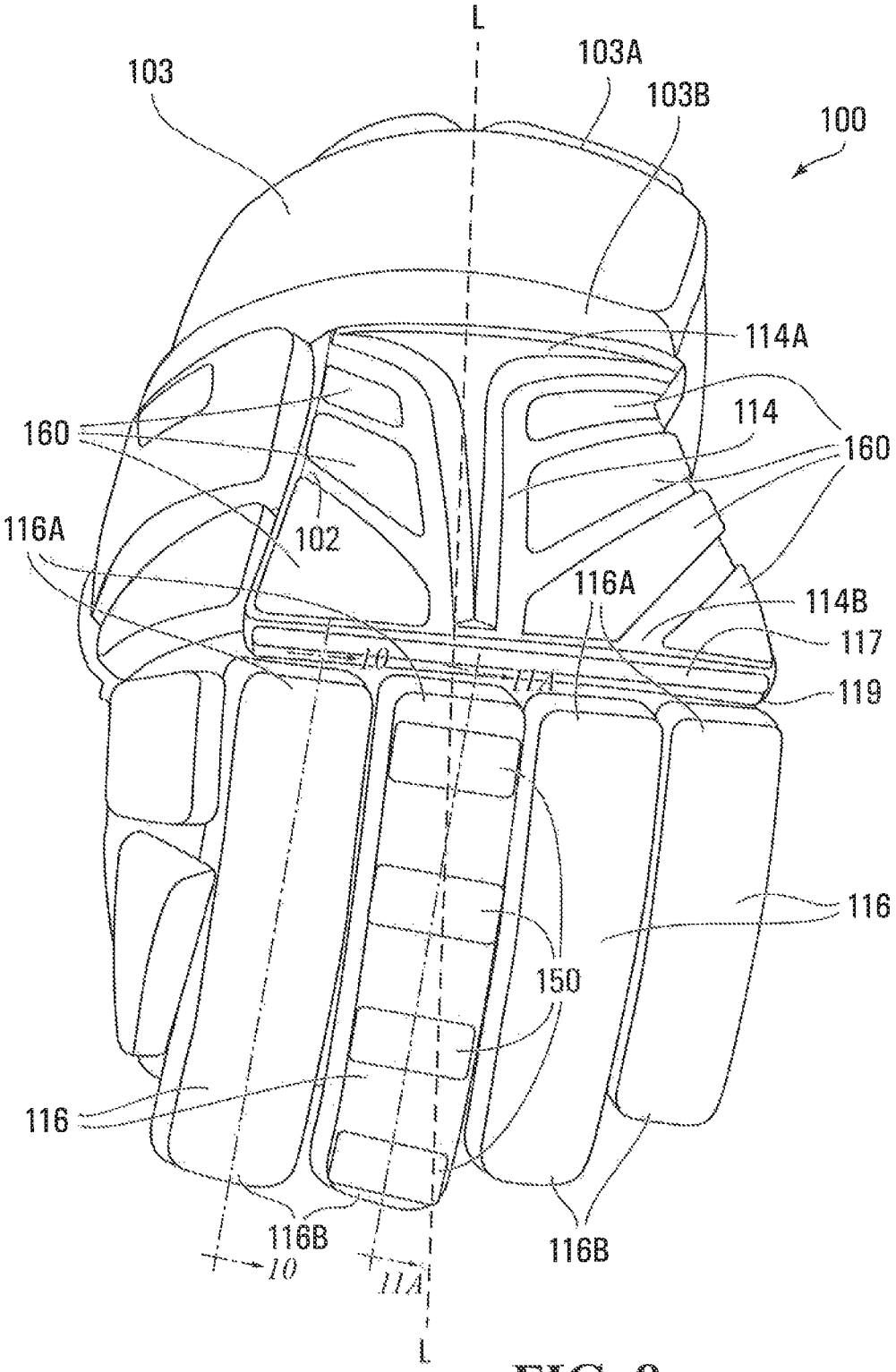
FIG. 8 is a top perspective view of the hockey or lacrosse glove of FIG. 7.

FIGS. 7 and 8 illustrate a hockey or lacrosse glove 100 constructed in accordance with a first embodiment of the invention.

The glove 100 has a hand receiving portion 102 for covering the palm and dorsal side of the hand and extending generally to the end of the fingers and a thumb sheath for covering the thumb. The glove 100 further comprises a cuff 103, which extends along a sufficient length for protecting the player's wrist and lower forearm of the player. The cuff 103 is secured to the hand covering portion 102 and has a proximal cuff edge 103A and a distal cuff edge 103B.

The hand receiving portion 102 may also have side pads located on the index finger gusset and extending generally from the base of the index finger gusset to approximately the distal end of the index finger gusset for protecting the side portion of the index finger.

The hand covering portion 102 further comprises four finger gussets 104 adapted to enclose the index finger, middle finger, ring finger and little finger of the player and palm and dorsal sheets 106, 108 connected to or integrated with a plurality of palm and dorsal finger sheets 107, 109 respectively.

Figure 13:
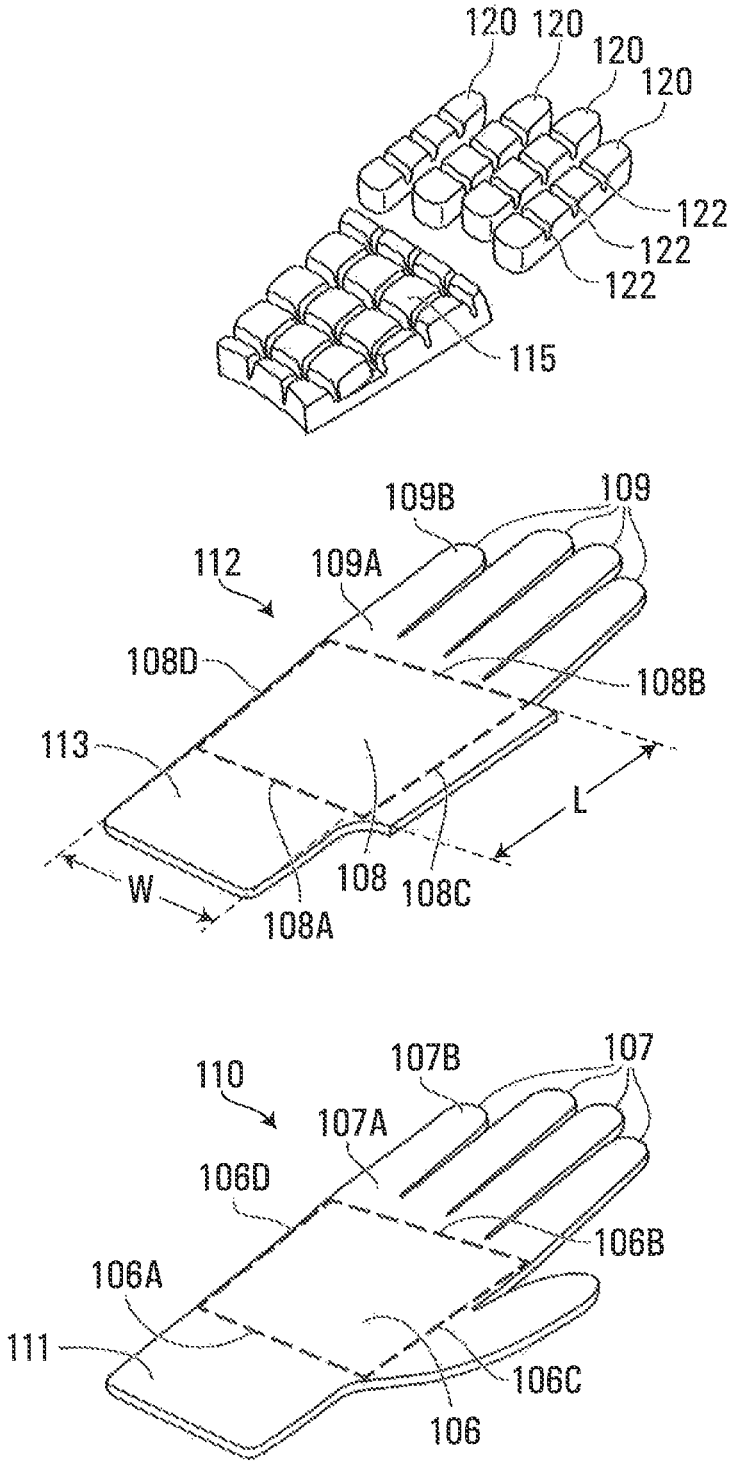
FIG. 13 is an exploded schematic view of a lower sheet, upper sheet, finger padding elements and dorsal padding element of the glove in accordance with the first embodiment of the present invention.

As best shown in FIG. 13, the palm and dorsal sheets 106, 108 are formed integral with their respective palm and dorsal finger sheets 107, 109 for defining lower and upper sheets 110, 112 for facing the palmar and dorsal regions of the player's hand of fingers and such lower and upper sheets 110, 112 may also have integrated proximal extensions 111, 113 for facing the lower and upper sides of the players' wrist and lower forearm. In other embodiments, the palm and dorsal sheets may be separate from (and attached to) the palm and dorsal finger sheets. The palm and dorsal sheets 106, 108 are adapted to overly the metacarpal region MR of the player's hand. As such, each of the palm and dorsal sheets 106, 108 respectively define proximal ends 106A, 108A, distal ends 106B, 108B, medial ends 106C, 108C and lateral ends 106D, 108D. In addition, each of the palm finger sheets and dorsal finger sheets 107, 109 also define respective proximal ends 107A, 109A and distal ends 107B, 109B.

Figure 9:
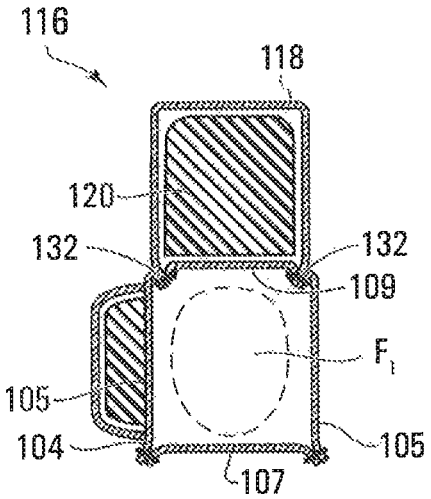
FIG. 9 is an enlarged cross-sectional view taken along lines 9-9 of FIG. 7.

As best shown in FIG. 9, the respective palm and dorsal finger sheets 107, 109 are connected to each other via a side finger web 105 to create the finger gussets 104.

The lower and upper sheets 110, 112 may be made of a suitable flexible material such as soft leather, leather-like materials, synthetic suede, or Nash fabric. An example of a suitable material is commercialized under the name CLARINO™. The lower and upper sheets 110, 112 may also be treated with silicone to improve stick control and may further be reinforced with a protective layer.

The hand receiving portion 102 also comprises a dorsal protector 114 for protecting the dorsal side of the player's hand. The dorsal protector 114 extends from a proximal dorsal end 114A to a distal dorsal end 114B. The dorsal protector 114 may comprise a single pocket mounted to the dorsal sheet 108 and occupying the entire dorsal sheet 108 and a padding element 115 contained in the single pocket. As best seen in FIG. 13, the padding element 115 may comprise four transversal flexion zones and three longitudinal flexion zones such that, in use, flexing of the player's hand imparts movement of the padding element 115 of the dorsal protector 114.

The hand receiving portion 102 also comprises four protectors 116 mounted on the four finger gussets 104 for respectively protecting the dorsal surfaces of the index finger, middle finger, ring finger and little finger. Each of the protectors 116 defines a first end 116A and a second end 116B. The first end 116A of each protector 116 is positioned proximate the distal end 108B of the dorsal sheet 108 (i.e. near the distal dorsal end 114B of the dorsal protector 114) and the second end 116B of each protector 116 is positioned proximate a distal end 104D of the finger gusset 104 (i.e. near the distal ends 107B, 109B of the lower and upper sheets 107, 109).

Each of the protectors 116 comprises a single pocket 118 mounted to the finger gusset 104 and extending longitudinally from the first end 116A proximate the distal end 108B of the dorsal sheet 108 to the second end 116B located generally above the distal end 104D of the finger gusset 104 and a padding element 120 contained in the single pocket 118. The padding element 120 defines at least one flexion zone 122 such that, in use, flexing of the player's finger imparts movement of the padding element 120. The single pocket 118 is formed by stitching a layer of material to the dorsal finger sheet 109 of the finger gusset 104 (see stitches 132). It is understood that the stitches 132 at least partially surround the single pocket 118 for closing the single pocket 118 and holding the single pocket 118 and padding element 120 in place on the finger gusset 104. In this embodiment, the padding element 120 provides continuous padding along a length of the finger gusset 104.

As shown in FIGS. 7 and 8, generally adjacent the distal dorsal end 114B, the glove 100 may comprise a proximal articulation spacer 117 which is positioned within a flexion zone 119. The proximal articulation spacer 117 may overlap each of the proximal articulations of the player's hand.

The arrangement described above eliminates the need to provide two or three distinct finger protectors with two or three flexion zones for each finger sheath and thus reduce design and production costs by providing fewer components and less manufacturing steps.

Figure 10:
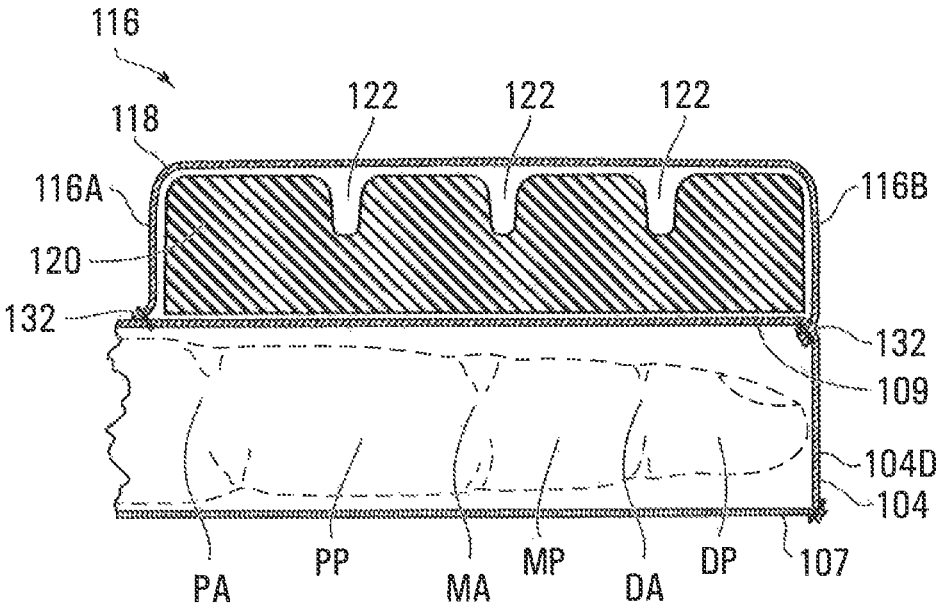
FIG. 10 is cross-sectional view taken along lines 10-10 of FIG. 8.

With reference to FIG. 10, a cross-sectional view of the protector 116 of the index finger is shown where the index finger is protected by the padding element 120 enclosed in the single pocket 118 that is mounted to the finger gusset 104. The padding element 120 may have three flexion zones 122 i.e. a first flexion zone for generally overlapping the middle articulation MA of the finger, a second flexion zone for generally overlapping the distal articulation DA of the finger and a third flexion zone that may generally overlap the middle region of the proximal phalanx PP.

The flexion zones 122 may generally define a "V-shape" or "U-shape" wherein the tip of the "V-shape" or "U-shape" is located near a middle or lower portion of the padding element 120. However, other embodiments can be envisioned wherein the flexion zone 122 has a different shape. While the padding element 120 has three flexion zones 122 positioned substantially equidistant from one another, other embodiments can readily be envisioned wherein the padding element includes any other number of flexion zones in any desired arrangement. For example, the padding element may include two flexion zones only, i.e. first and second flexion zones for generally overlying the middle and distal articulations MA, DA of the player's finger. It will become apparent to a person skilled in the art that a variety of arrangements of flexion zones 122 may be implemented.

Figure 11A:
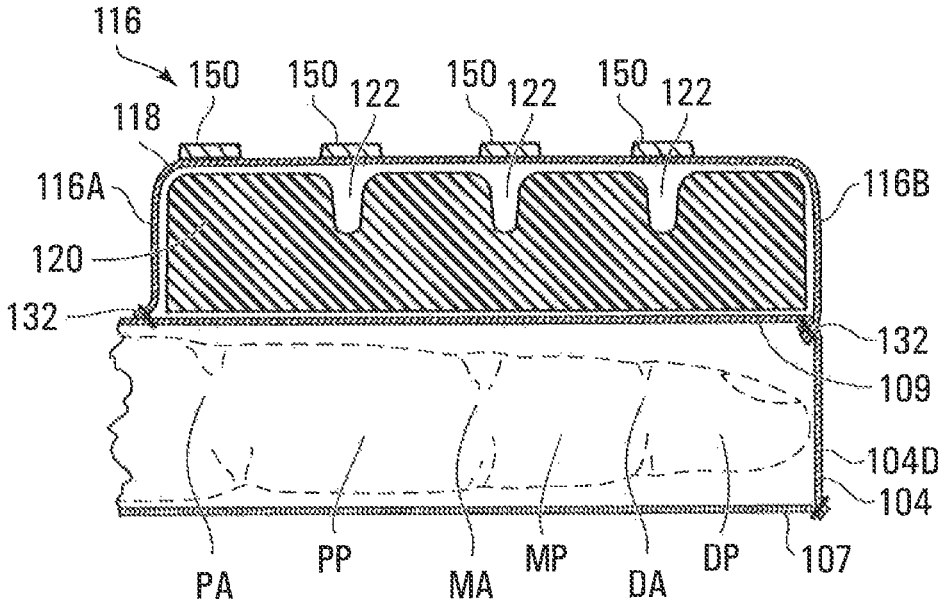
FIG. 11A is cross-sectional view taken along lines 11A-11A of FIG. 8.

With reference to FIG. 11A, a cross-sectional view of the finger protector 116 of the middle finger is shown. Similar to the arrangement of the index finger discussed above, the middle finger is protected by the padding element 120 enclosed in the single pocket 118 that is mounted to the finger gusset 104. The protector 116 of the middle finger differs from the other protectors 116 in that a plurality of overlay elements 150 are positioned along the length of the corresponding single pocket 118. More specifically, in the embodiment shown, the protector 116 includes four overlay elements 150 which have a generally rectangular geometry and a thickness of approximately 1.0 mm to 2.0 mm. The overlay elements 150 can be made of any material which may provide an additional level of protection to the player's finger. For example, the overlay elements 150 can be made of plastic such as polyvinyl chloride (PVC) or polyethylene terephtalate (PET). Furthermore, the overlay elements 150 can be attached to the upper surface or layer of the single pocket 118 via any appropriate means such as by fusing the plastic to the fabric, sewing, via an adhesive, etc. The overlay elements 150 can be reinforcement elements or merely decorative elements. It is understood that other overlays elements may be mounted to the upper surfaces or layers of the single pockets 118 of the protectors 116 for the index, ring and little fingers.

Figure 11B:
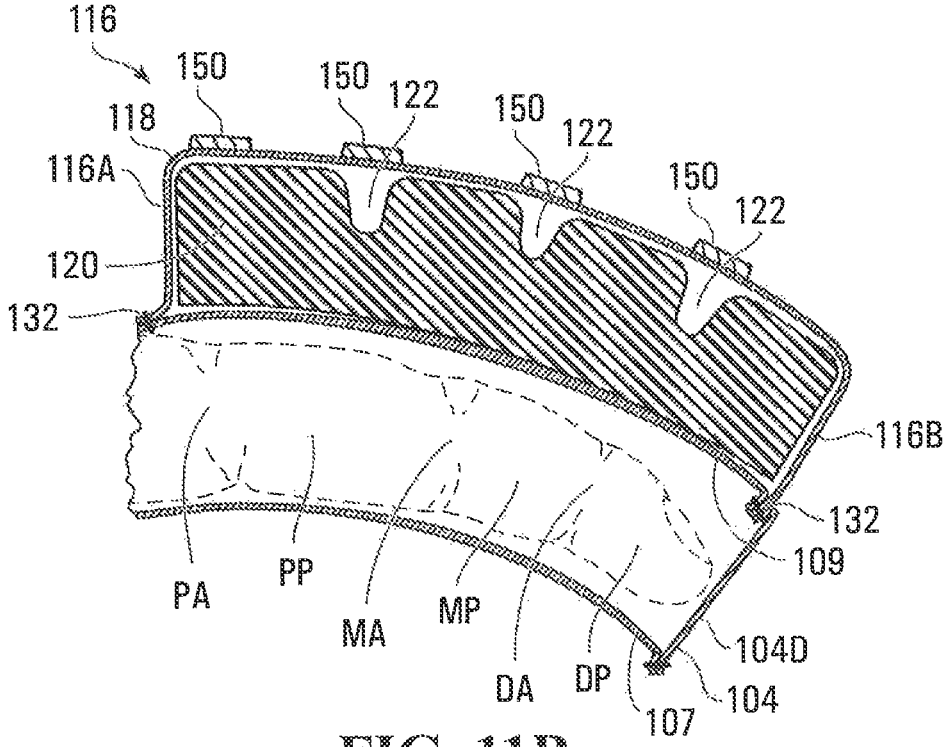
FIG. 11B is a cross-sectional view similar to FIG. 11A, wherein the finger is in a contracted or flexed position.

One or more of the overlay elements 150 may positioned along the single pocket 118 to generally overlap one or more of the flexion zones 122 of the padding element 120. As such, if the player's finger is contracted or flexed, as shown in FIG. 11B, the fabric of the single pocket 118 may stretch while the overlay elements 150 would still overly the flexion zones 122 of the padding element 120. Thus, the overlay elements 150 may offer further protection in the region of the flexion zones 122. While the overlay elements 150 are shown as having a rectangular geometry, other patterns and shapes can be considered.

As seen inn FIGS. 7 and 8, the glove 100 may also comprise overlay elements 160 mounted, affixed, molded, stitched or glued on an upper surface or layer of the single pocket of the dorsal protector 114.

Thus, the overlay elements 150, 160 can provide an inexpensive option to enhance the level of protection provided by the glove 100. Furthermore, the overlay elements 150, 160 can also give the glove 100 a decorative and more detailed visual appearance, thereby mimicking the appearance of a glove having a plurality of different and distinct dorsal and finger protectors separated by a plurality of gaps, spaces, grooves, channels or flexion zones. It is understood that the overlay elements 150, 160 may be primarily aesthetic while providing lithe additional protection.

Figure 12:
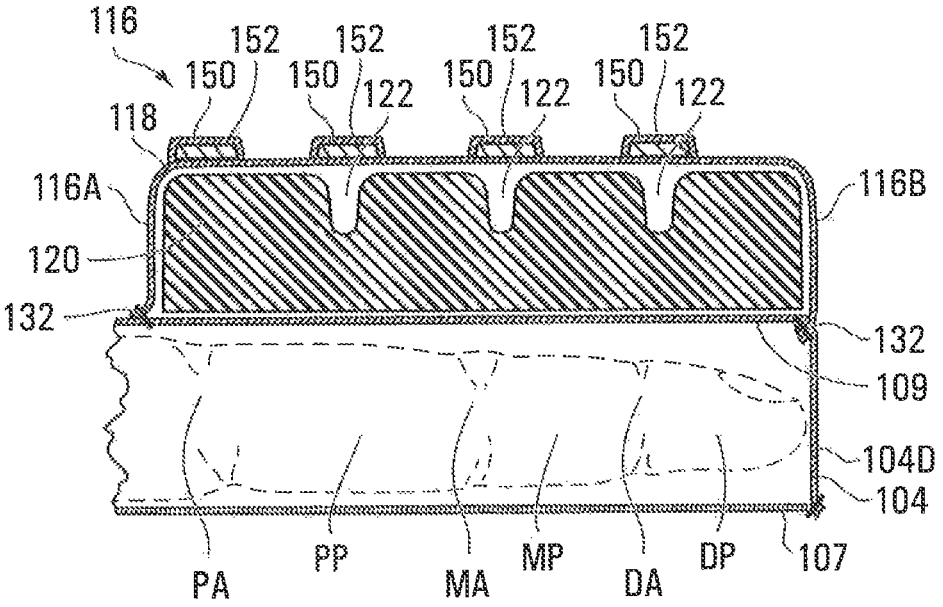
FIG. 12 is a cross-sectional view similar to FIG. 11A, wherein the finger portion further comprises covering layers over the overlays.

In the protector 116 shown in FIG. 12, the overlay elements 150 are contained between the single pocket 118 and a covering layer 152 that is attached to the upper surface or layer of the pocket 118 and/or to the overlay element 150. The overlay elements 150 may be attached to either of the single pocket 118 and covering layer 152. Alternatively, the overlay elements 150 can simply lie between the single pocket 118 and covering layer 152.

Figure 14:
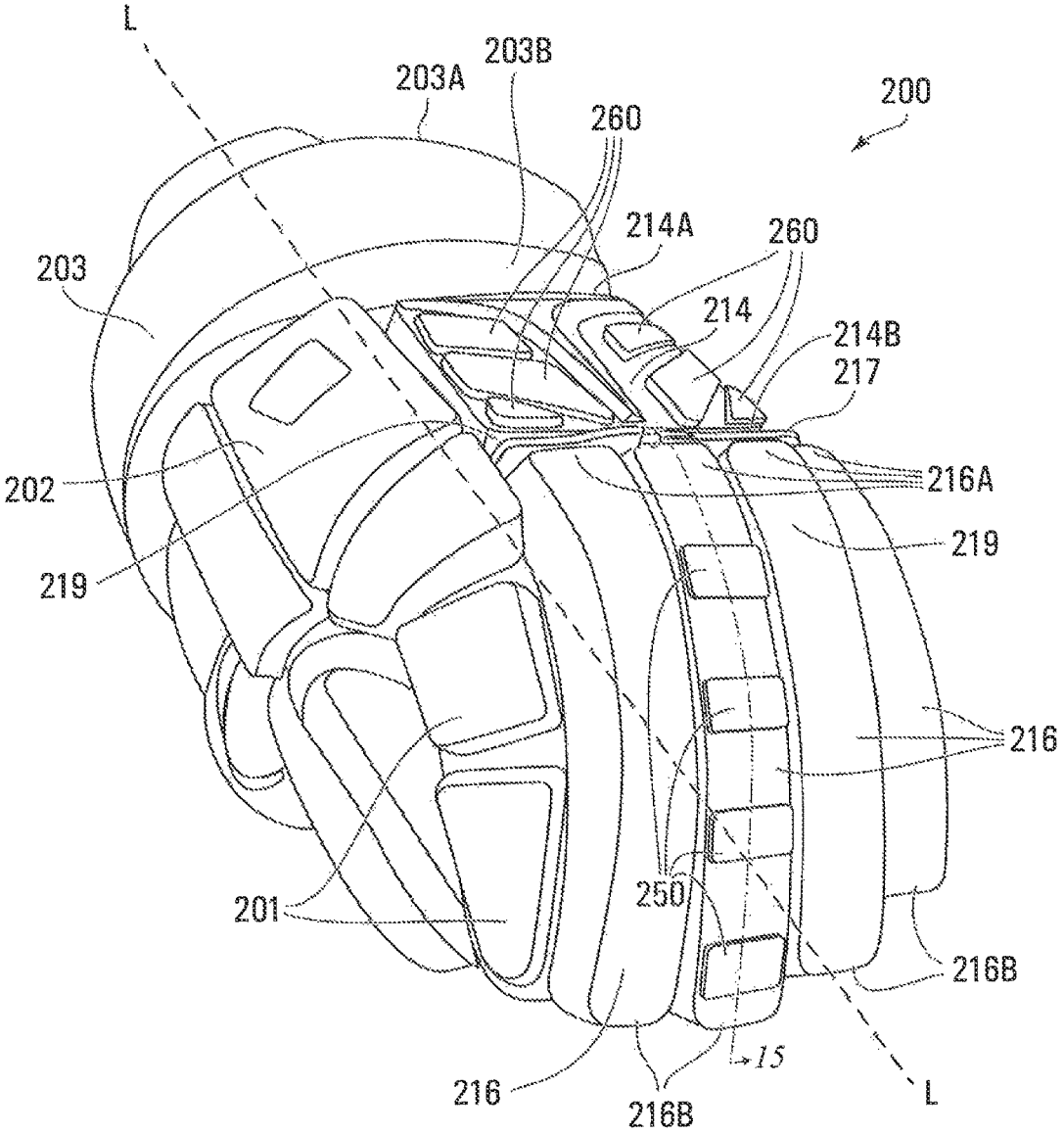
FIG. 14 is a perspective view of a hockey or lacrosse glove constructed in accordance with a second embodiment of the invention.

FIG. 14 shows a hockey or lacrosse glove 200 in accordance with a second embodiment of the invention (it is noted that elements of glove 200 which are similar to those of glove 100 are designated by similar reference numerals in the 200 series).

The hand receiving portion 202 comprises a dorsal protector 214 for protecting the dorsal side of the player's hand. The dorsal protector 214 extends from a proximal dorsal end 214A to a distal dorsal end 214B. The dorsal protector 214 may comprise a single pocket mounted to the dorsal sheet 208 and occupying a proximal portion of the dorsal sheet 208 and a padding element 215 contained in the single pocket.

Figure 15:
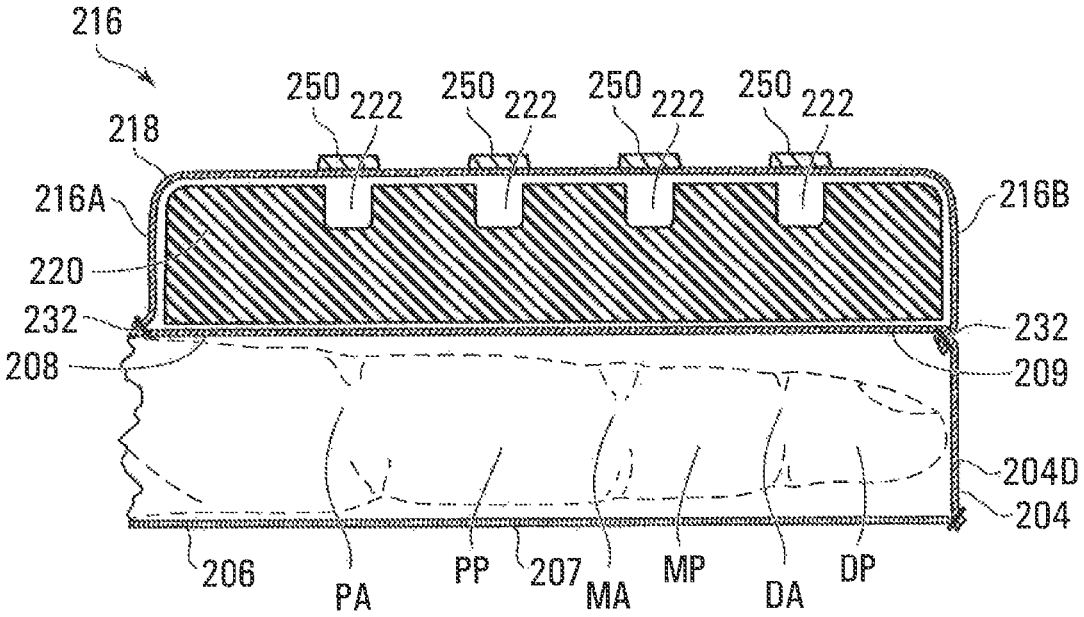
FIG. 15 is an enlarged cross-sectional view taken along lines 15-15 of FIG. 14.

The hand receiving portion 202 also has four protectors 216 that each extends beyond the respective proximal articulations PA of the player's hand. More specifically, each of the protectors 216 has a single pocket 218 mounted to the dorsal sheet 208 and finger gusset 204 and extending longitudinally from a first end 216A located between the proximal and distal ends 208A, 208B of the dorsal sheet 208 to a second end 216B located generally above the distal end 204D of the finger gusset 204 and a padding element 220 contained in the single pocket 218, the padding element 220 defining at least one flexion zone 222 such that, in use, flexing of the player's hand or finger imparts movement of the padding element 220. As best seen in FIG. 15, the padding element 220 may have a first flexion zone for generally overlapping the middle articulation MA of the finger, a second flexion zone for generally overlapping the distal articulation DA of the finger, a third flexion zone that may generally overlap the middle region of the proximal phalanx PP, and a fourth flexion zone for generally overlapping the proximal articulation PA of the finger. The protector 216 may also have four overlay elements 250 for overlying the four flexion zones 222.

Figure 16:
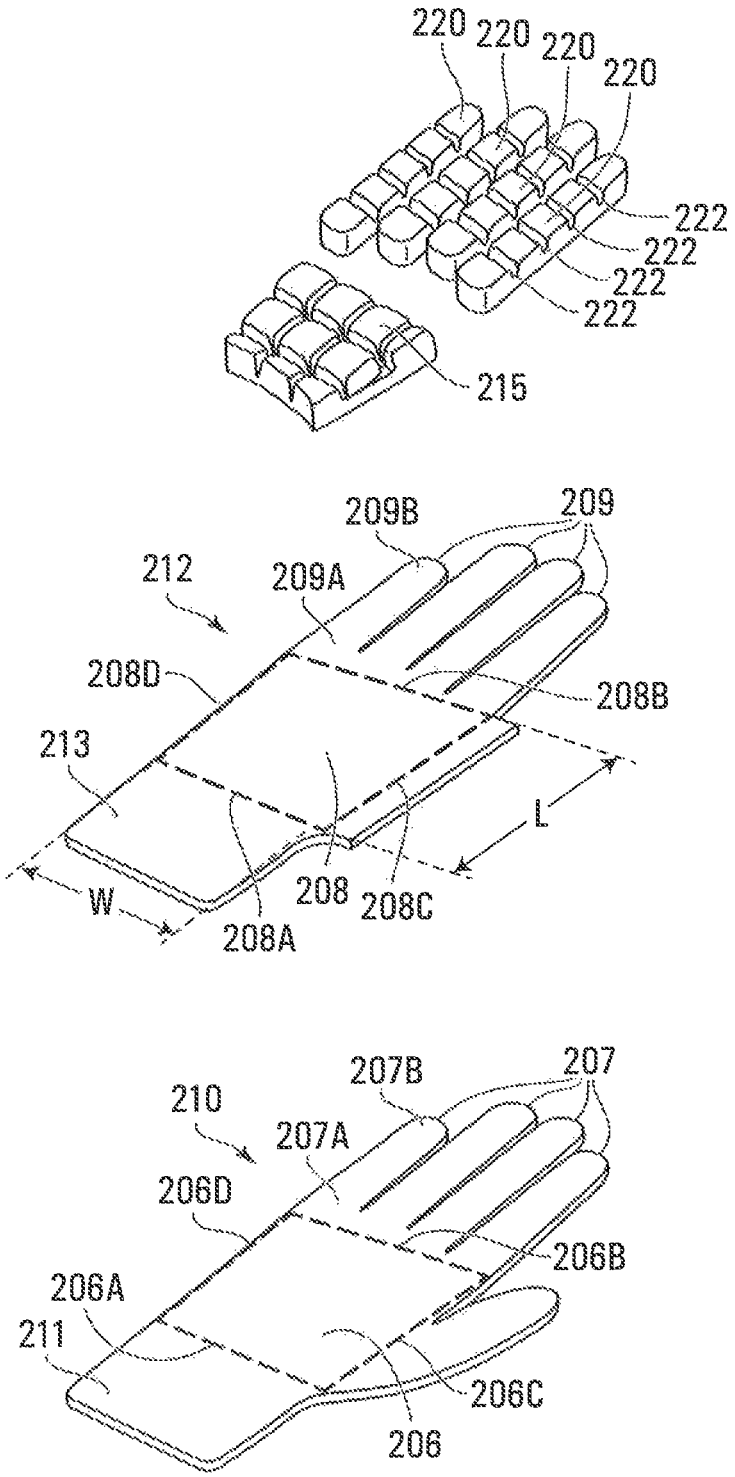
FIG. 16 is an exploded schematic view of a lower sheet, upper sheet, finger padding elements and dorsal padding element of the glove in accordance with the second embodiment of the present invention.

As best seen in FIG. 16, the padding element 215 is shorter than the padding element 115 because each of the four protectors 216 extends beyond the respective proximal articulations PA of the player's hand. As such, the dorsal protector 214 may extend from the distal cuff end 203B and occupy three-quarter or half of the maximal length L of the dorsal sheet 208. Because it is shorter, the padding element 215 may only comprise two transversal flexion zones instead of the four transversal longitudinal flexion zones provided in the padding element 115.

As shown in FIG. 14, generally adjacent the distal dorsal end 214B, the glove 200 may comprise a spacer 217 which is positioned within a flexion zone 219.

Figure 17:
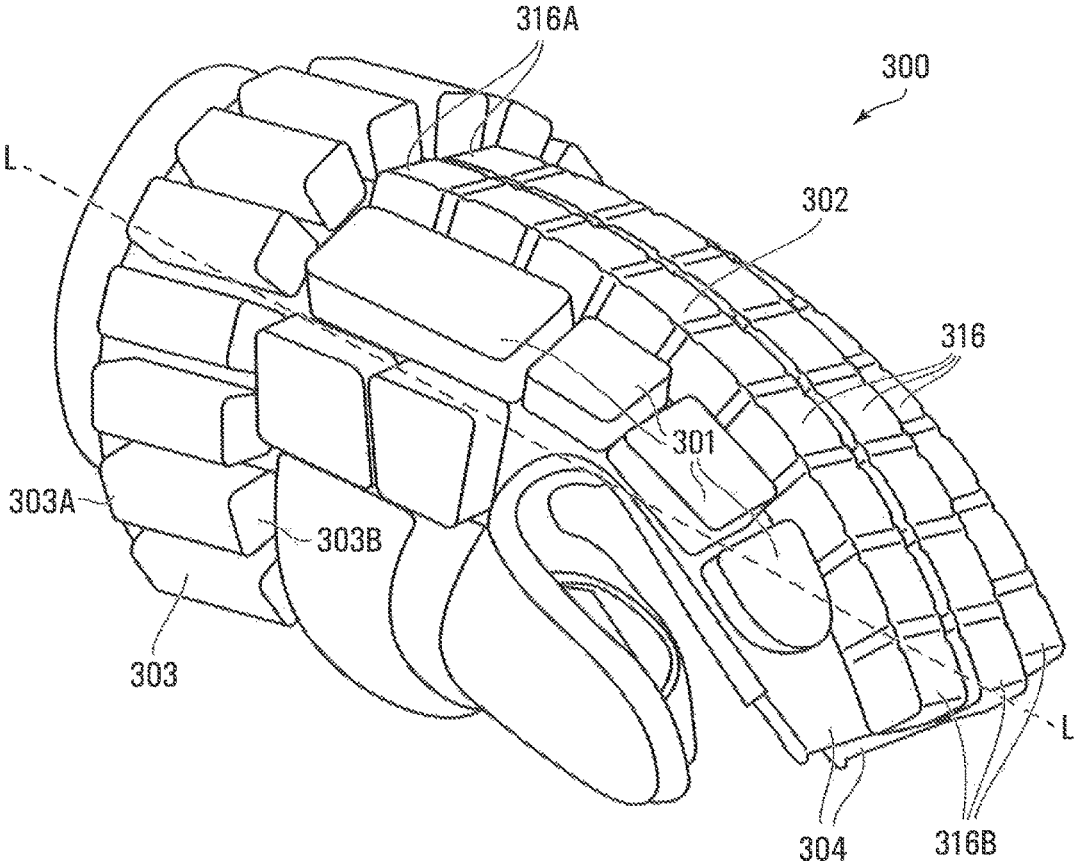
FIG. 17 is a perspective view of a hockey or lacrosse glove constructed in accordance with a third embodiment of the invention.
Figure 18:
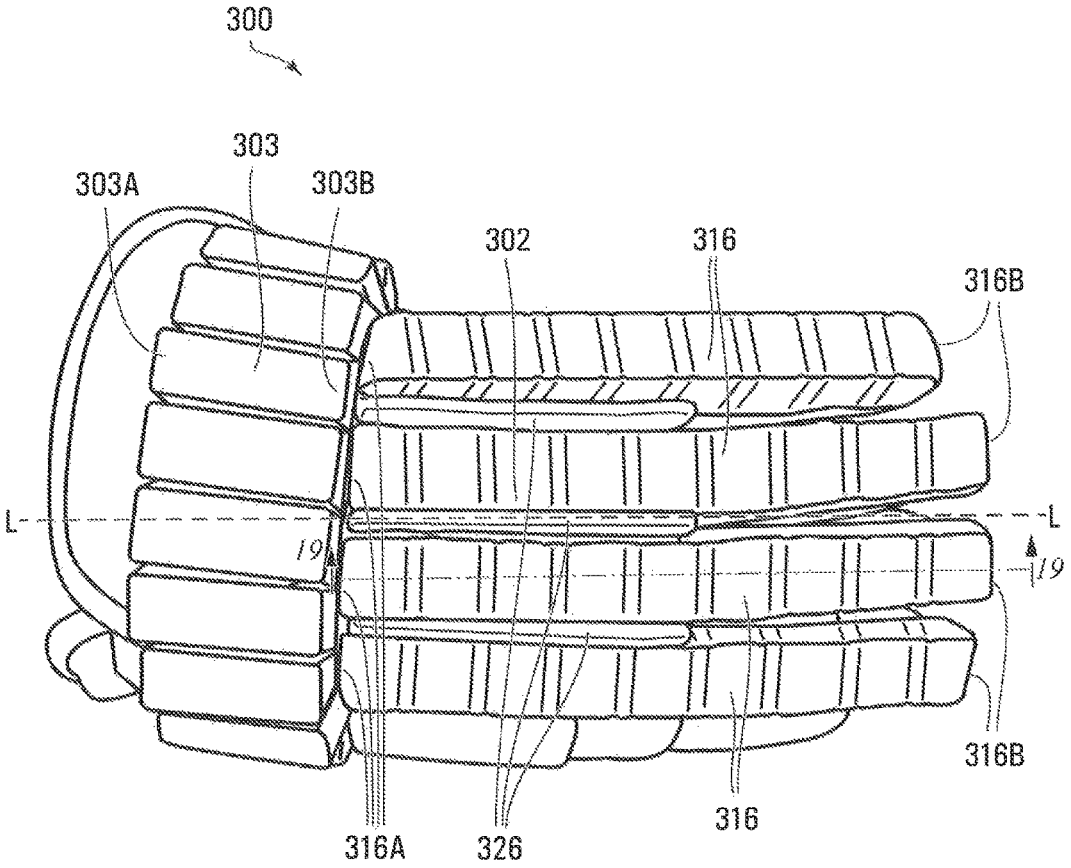
FIG. 18 is a top view of the hockey or lacrosse glove of FIG. 17.
Figure 20:
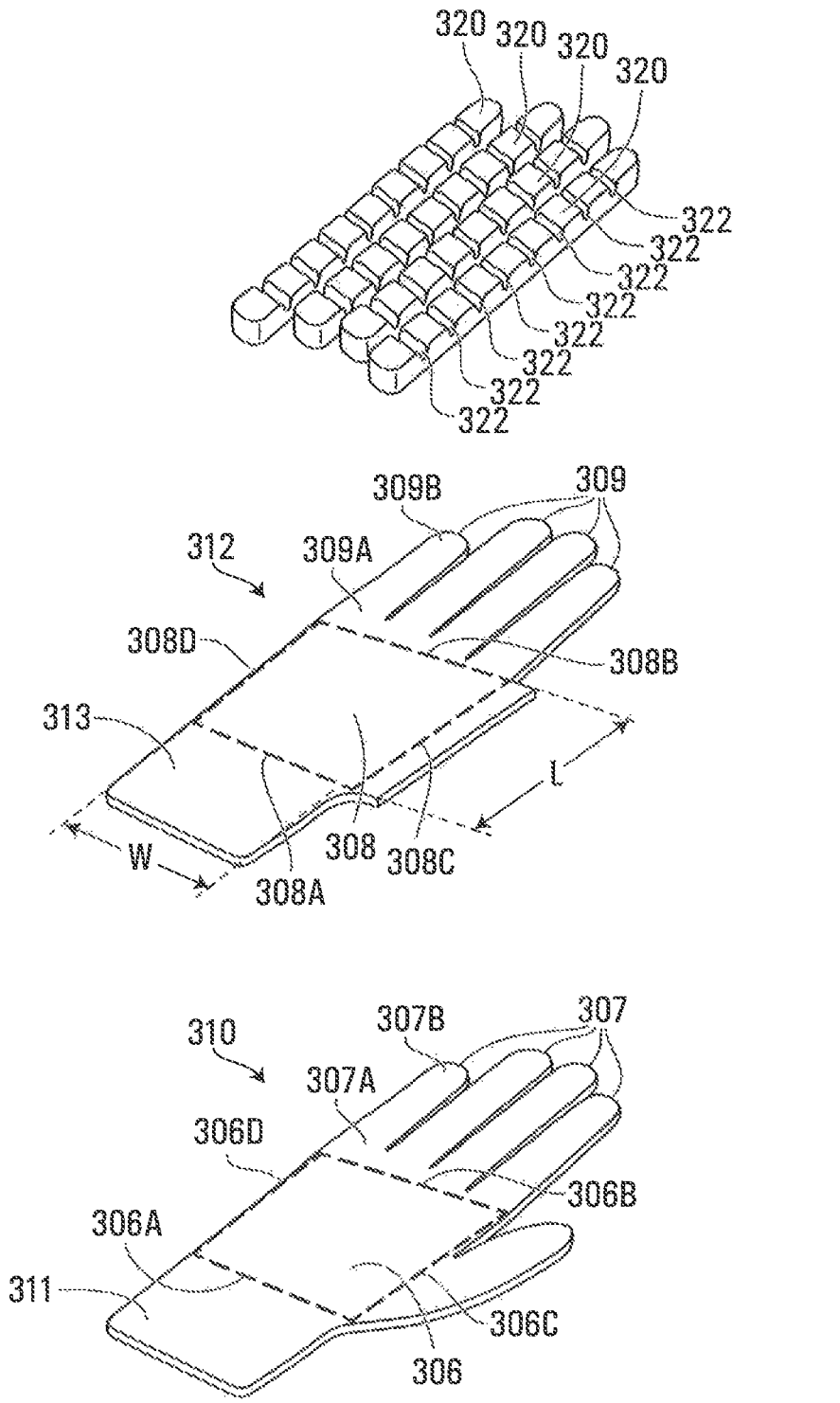
FIG. 20 is an exploded schematic view of a lower sheet, upper sheet and dorsal/finger padding elements of the glove in accordance with the third embodiment of the present invention.

With reference to FIGS. 17 and 18, a hockey or lacrosse glove 300 in accordance with a third embodiment of the invention is shown. The glove 300 has side pads 301 for protecting the side portion of a player's index finger, a hand receiving portion 302 and a cuff 303. The cuff 303 defines a proximal cuff end 303A and a distal cuff end 303B. The hand receiving portion 302 has four protectors 316, each finger protector 316 comprising a single pocket 318 mounted to the dorsal sheet 308 and finger gusset 304 and extending longitudinally from a first end 316 located adjacent the proximal end 308A of the dorsal sheet 308 (or adjacent the distal cuff end 303B) to a second end 316B located generally above the distal end 304D of the finger gusset 304 and a padding element 320 contained in the single pocket 318, the padding element 320 defining at least one flexion zone 322 such that, in use, flexing of the player's hand or finger imparts movement of the padding element 320. The four padding elements 320, upper sheet 312 with its extension 313 and dorsal/finger sheets 308, 309 and lower sheet 310 with its extension 311 and palm/finger sheets 306, 307 are shown in FIG. 20.

Figure 19:
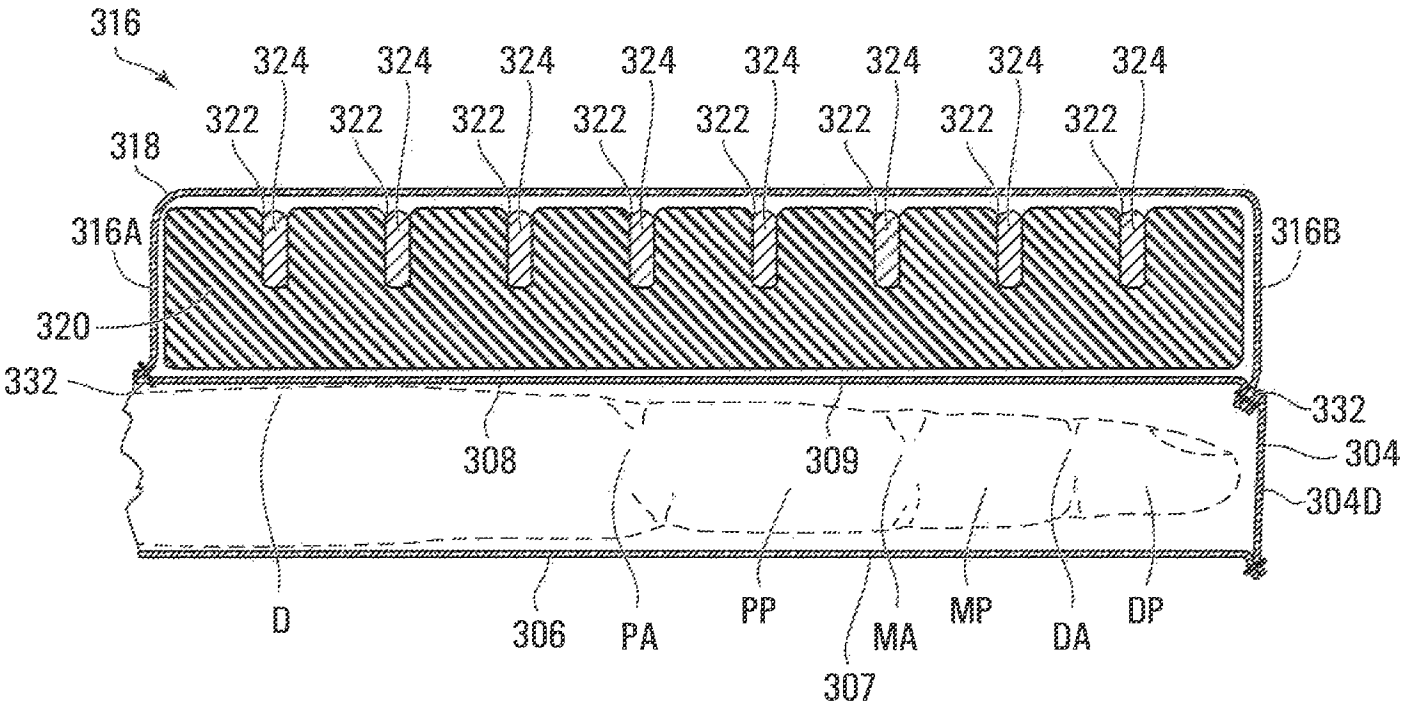
FIG. 19 is a cross-sectional view taken along lines 19-19 of FIG. 18.

As best seen in FIG. 19, the padding element 320 may have a first flexion zone for generally overlapping the middle articulation MA of the finger, a second flexion zone for generally overlapping the distal articulation DA of the finger, a third flexion zone that may generally overlap the middle region of the proximal phalanx PP, a fourth flexion zone for generally overlapping the proximal articulation PA of the finger, and fifth, sixth, seventh and eighth flexion zones for overlapping the dorsal side D of the player's hand. Inserts 324 may be provided in one or more of the flexion zones 322.

As best seen in FIG. 18, the hand receiving portion 302 may also comprise thee longitudinal protectors 326 affixed to the dorsal sheet 308 and each located between two protectors 316.

As such, if provided for each finger, the protectors 316 respectively protect the entirety of the fingers while also collectively protecting the dorsal side of the player's hand. This therefore eliminates the need to manufacture a separate dorsal protector as dorsal protectors 114, 214 or dorsal protectors constructed according to any other arrangement known in the art. Furthermore, as discussed above in relation to the gloves of the first and second embodiments, either of the single pockets 318 may have a pattern of decorative elements.

While the embodiments described above discuss specific arrangements, different arrangements can be envisioned for a particular glove. For example, some gloves may have padding elements with flexion zones implemented on more than one padding element. Other gloves may implement padding elements without flexion zones for all of the fingers. In addition, decorative or reinforcement elements can be attached to any or none of the single pockets as desired. In addition, while the padding elements have been shown as unitary elements within a respective single pocket, it can be understood that multiple padding elements can be positioned within the single pocket.

In yet other embodiments, selected ones of the finger padding regions could be constructed according to the embodiments of the present invention. For example, only the finger padding region which covers the index finger can include a padding element housed in a single pocket, while the finger padding regions of the other fingers may be constructed according to any other arrangement known in the art. Other embodiments can be envisioned wherein only two or three of the finger padding regions are constructed according to the embodiments of the present invention.

Any feature of any embodiment discussed herein may be combined with any feature of any other embodiment discussed herein in some examples of implementation. Various embodiments and examples have been presented for the purpose of describing, but not limiting, the invention. Various modifications and enhancements will become apparent to those of ordinary skill in the art and are within the scope of the invention, which is defined by the appended claims.

The invention claimed is:

1. A glove configured to protect a hand of a hockey or lacrosse player, the player's hand having a wrist, a palm, a dorsal side, four fingers and a thumb, each finger extending from a proximal articulation to a distal end, the hockey or lacrosse glove comprising a hand receiving portion and a cuff for at least partially covering the wrist, the cuff extending longitudinally from a proximal end to a distal end, the hand receiving portion comprising:

(a) a palm sheet for covering the palm of the player's hand;

(b) a dorsal sheet for covering the dorsal side of the player's hand, the dorsal sheet extending longitudinally from a proximal end located adjacent the distal end of the cuff to a distal end that is, in use, located above the proximal articulation of each finger;

(c) a thumb sheath for protecting the thumb of the player's hand;

(d) four finger gussets for receiving the four fingers, each finger gusset having a distal end for covering the distal end of the finger; and (e) at least one protector comprising (i) a single pocket mounted to one of the four finger gussets and extending longitudinally from above the distal end of the finger gusset to at least the distal end of the dorsal sheet; (ii) a padding element contained in the single pocket and capable of directly contacting the single pocket, the padding element comprising at least one flexion zone such that, in use, flexing of the player's finger imparts movement of the padding element, a material of the padding element being continuous across the at least one flexion zone, and a thickness of said material within the at least one flexion zone being different from a thickness of said material outside the at least one flexion zone; and (iii) a gap defined between the single pocket overlapping the padding element and said padding element in the at least one flexion zone, such that a spacing between the single pocket and the padding element across the at least one flexion zone is greater than a spacing between the single pocket and the padding element outside the at least one flexion zone.

2. The hockey or lacrosse glove of claim 1, wherein the single pocket extends longitudinally to a location that is proximate the distal end of the dorsal sheet.

3. The hockey or lacrosse glove of claim 2, wherein the four fingers are an index finger, a middle finger, a ring finger and a little finger and wherein the at least one protector includes a first finger protector configured to protect the index finger.

4. The hockey or lacrosse glove of claim 3, wherein the at least one protector further includes a second finger protector for protecting either of the middle finger, ring finger and little finger.

5. The hockey or lacrosse glove of claim 2, wherein the at least one protector includes four finger protectors, each one of the four finger protectors respectively configured to protect one of the four fingers of the player's hand.

6. The hockey or lacrosse glove of claim 2, wherein the at least one flexion zone is a first flexion zone configured to overlap a middle articulation of one finger and wherein the padding element further comprises a second flexion zone configured to overlap a distal articulation of the finger.

7. The hockey or lacrosse glove of claim 2, further comprising at least one overlay element attached to the single pocket.

8. The hockey or lacrosse glove of claim 7, wherein the at least one overlay element overlaps the at least one flexion zone.

9. The hockey or lacrosse glove of claim 8, further comprising a covering layer affixed to an upper layer of the single pocket and wherein the at least one overlay element is contained between the covering and upper layers.

10. The hockey or lacrosse glove of claim 2, wherein the material is thermoformed for defining the at least one flexion zone.

11. The hockey or lacrosse glove of claim 1, wherein the single pocket extends longitudinally to a location between the proximal and distal ends of the dorsal sheet.

12. The hockey or lacrosse glove of claim 11, wherein the four fingers are index finger, middle finger, ring finger and little finger and wherein the at least one protector includes a first finger protector for protecting the index finger.

13. The hockey or lacrosse glove of claim 12, wherein the at least one protector further includes a second protector for protecting either of the middle finger, ring finger and little finger.

14. The hockey or lacrosse glove of claim 11, wherein the at least one protector includes four protectors, each one of the four finger protectors configured to protect a respective one of the four fingers of the player's hand.

15. The hockey or lacrosse glove of claim 11, wherein the at least one flexion zone is a first flexion zone for overlapping a middle articulation of one finger and wherein the padding element further comprises a second flexion zone for overlapping a distal articulation of the finger and a third flexion zone for overlapping a proximal articulation of the finger.

16. The hockey or lacrosse glove of claim 11, further comprising at least one overlay element attached to the single pocket.

17. The hockey or lacrosse glove of claim 16, wherein the at least one overlay element overlaps the at least one flexion zone.

18. The hockey or lacrosse glove of claim 17, further comprising a covering layer affixed to an upper layer of the single pocket and wherein the at least one overlay element is contained between the covering and upper layers.

19. The hockey or lacrosse glove of claim 11, wherein the material is thermoformed for defining the at least one flexion zone.

20. The hockey or lacrosse glove of claim 11, wherein the dorsal sheet has a maximal length measured between its proximal and distal ends along one given finger when the glove is worn and wherein the single pocket and padding element of the at least one protector overly an entire length of the finger gusset configured to receive the given finger and at least one-quarter of the maximal length of the dorsal sheet.

21. The hockey or lacrosse glove of claim 11, wherein the dorsal sheet has a maximal length measured between its proximal and distal ends along one given finger when the glove is worn and wherein the single pocket and padding element of the at least one protector overly an entire length of the finger gusset configured to receive the given finger and at least one-third of the maximal length of the dorsal sheet.

22. The hockey or lacrosse glove of claim 1, wherein the single pocket extends longitudinally to a location adjacent the proximal end of the dorsal sheet.

23. The hockey or lacrosse glove of claim 22, wherein the four fingers are index finger, middle finger, ring finger and little finger and wherein the at least one protector includes a first protector for protecting the index finger from the proximal end of the dorsal sheet to the distal end of the finger gusset receiving the index finger.

24. The hockey or lacrosse glove of claim 23, wherein the at least one protector further includes a second protector for protecting either of the middle finger, ring finger and little finger from the proximal end of the dorsal sheet to the distal end of the finger gusset configured to receive either of the middle finger, ring finger and little finger.

25. The hockey or lacrosse glove of claim 22, wherein the at least one protector includes four protectors, each one of the four protectors configured to protect a respective one of the four fingers from the proximal end of the dorsal sheet to the distal end of the finger gusset configured to receive the one of the four fingers.

26. The hockey or lacrosse glove of claim 22, wherein the at least one flexion zone is a first flexion zone for overlapping a middle articulation of one finger and wherein the padding element further comprises a second flexion zone for overlapping a distal articulation of the finger, a third flexion zone for overlapping a proximal articulation of the finger, and fourth and fifth flexion zones for overlapping the finger's metacarpal.

27. The hockey or lacrosse glove of claim 22, further comprising at least one overlay element attached to the single pocket.

28. The hockey or lacrosse glove of claim 27, wherein the at least one overlay element overlaps the at least one flexion zone.

29. The hockey or lacrosse glove of claim 28, further comprising a covering layer affixed to an upper layer of the single pocket and wherein the at least one overlay element is contained between the covering and upper layers.

30. The hockey or lacrosse glove of claim 22, wherein the material is thermoformed for defining the at least one flexion zone.

31. The hockey or lacrosse glove of claim 1, wherein the single pocket extends longitudinally to the distal end of the dorsal sheet.

32. The hockey or lacrosse glove of claim 1, wherein the single pocket extends longitudinally to the proximal end of the dorsal sheet.

33. The hockey or lacrosse glove of claim 1, wherein the single pocket extends longitudinally to a location that is between the distal and proximal ends of the dorsal sheet, and closer to the distal end of the dorsal sheet than the proximal end of the dorsal sheet.

34. The hockey or lacrosse glove of claim 1, wherein the single pocket extends longitudinally to a location that is between the distal and proximal ends of the dorsal sheet, and closer to the proximal end of the dorsal sheet than to the distal end of the dorsal sheet.

35. A hockey or lacrosse glove with a hand receiving portion that comprises:

a plurality of finger gussets for receiving fingers of a hand, each finger gusset extending along a length from a proximal end to a distal end; and at least one protector mounted to one of the finger gussets and comprising a pocket and a padding element contained within the pocket, the padding element capable of directly contacting the pocket, the padding element being made of a flexible material, the flexible material of the padding element providing continuous padding along the length of the finger gusset, the padding element comprising at least one flexion zone where a thickness of said flexible material of the padding element is reduced to facilitate movement of the padding element in response to flexing of the player's finger, a thickness of said flexible material of the padding element within the at least one flexion zone being different from a thickness of said flexible material of the padding element outside the at least one flexion zone, and a distance between the pocket and the padding element across the at least one flexion zone is greater than a distance between the pocket and the padding element outside the at least one flexion zone.

36. The hockey or lacrosse glove defined in claim 35, wherein each of the at least one flexion zone is U-shaped or V-shaped.

37. A hockey or lacrosse glove comprising:

a dorsal sheet for covering a dorsal side of a hand inserted into the glove;

finger gussets for receiving fingers of the hand, each finger gusset extending along a length from a proximal end to a distal end; and at least one protector, each of the at least one protector comprising:

i) a single pocket extending from above an end of one of the finger gussets to the dorsal sheet; and ii) a padding element contained in the single pocket and capable of directly contacting the single pocket, the padding element comprising at least one flexion zone such that, in use, flexing of a finger inside the finger gusset imparts movement of the padding element, a material of the padding element extends continuously along the length of the finger gusset, a thickness of said material within the at least one flexion zone being different from a thickness of said material outside the at least one flexion zone, such that the at least one flexion zone defines a gap between the padding element within the at least one flexion zone and a portion of the single pocket overlying said at least one flexion zone.

* * * * *